US012590703B2

(12) United States Patent
Keil et al.

(10) Patent No.: US 12,590,703 B2
(45) Date of Patent: Mar. 31, 2026

(54) ELECTRONIC CLOSED-LOOP CONTROL DEVICE FOR FIREPLACES COMPRISING A LOWER COMBUSTION SYSTEM

(71) Applicant: MAXITROL GMBH & CO. KG, Thale (DE)

(72) Inventors: Peter Keil, Thale (DE); Sven Malecha, Thale (DE)

(73) Assignee: MAXITROL GMBH & CO. KG, Thale (DE)

( * ) Notice: Subject to any disclaimer, the term of this patent is extended or adjusted under 35 U.S.C. 154(b) by 368 days.

(21) Appl. No.: 18/023,089

(22) PCT Filed: Aug. 13, 2021

(86) PCT No.: PCT/DE2021/000135
§ 371 (c)(1),
(2) Date: Feb. 24, 2023

(87) PCT Pub. No.: WO2022/042782
PCT Pub. Date: Mar. 3, 2022

(65) Prior Publication Data

US 2024/0295324 A1 Sep. 5, 2024

(30) Foreign Application Priority Data

Aug. 25, 2020 (DE) ..... 10 2020 005 202.9

(51) Int. Cl.
*F24B 1/02* (2006.01)
*F24B 13/00* (2006.01)

(52) U.S. Cl.
CPC ..... *F24B 1/028* (2013.01); *F24B 13/004* (2013.01)

(58) Field of Classification Search
CPC .... F24B 1/028; F24B 13/004; F23N 2223/48; F23N 5/003

(Continued)

(56) References Cited

U.S. PATENT DOCUMENTS 4,362,146 A * 12/1982 Schuller ..... F24B 5/025 126/501
4,373,452 A * 2/1983 Van Dewoestine ..... F24B 1/006 422/177

(Continued)

FOREIGN PATENT DOCUMENTS

AT 507930 A4 9/2010
DE 69204960 T2 4/1996

(Continued)

OTHER PUBLICATIONS

International Search Report mailed Dec. 13, 2021; International Patent Application No. PCT/DE2021/000135 filed Apr. 25, 2020. ISA/EP.

*Primary Examiner* — Vivek K Shirsat
(74) *Attorney, Agent, or Firm* — McDonald Hopkins LLC

(57) ABSTRACT

The aim is to create a facility which is carried out without operator intervention, operates without delay, does not require a connection to the mains and meets the requirements of the regulations on permissible pollutant emissions. The device consists of a control unit which is electrically connected to two temperature sensors and a door contact switch and actuates an actuator via an electric motor and transmission elements. The temperature detection in the flue takes place behind the outlet of the respective combustion chamber. The temperature sensors record the temperature change over time and the speed of the temperature change. The temperature target-actual evaluation serves to record the burning state of the solid fuel. The degree of the outgassing process is carried out by recording and evaluating the temperature rise or temperature drop over time. The target-actual temperature over time in comparison with comparative values for combustion optimization is carried out as an adaptive system. Thus, the respective nature of the solid fuel (Continued)

Figure 1:
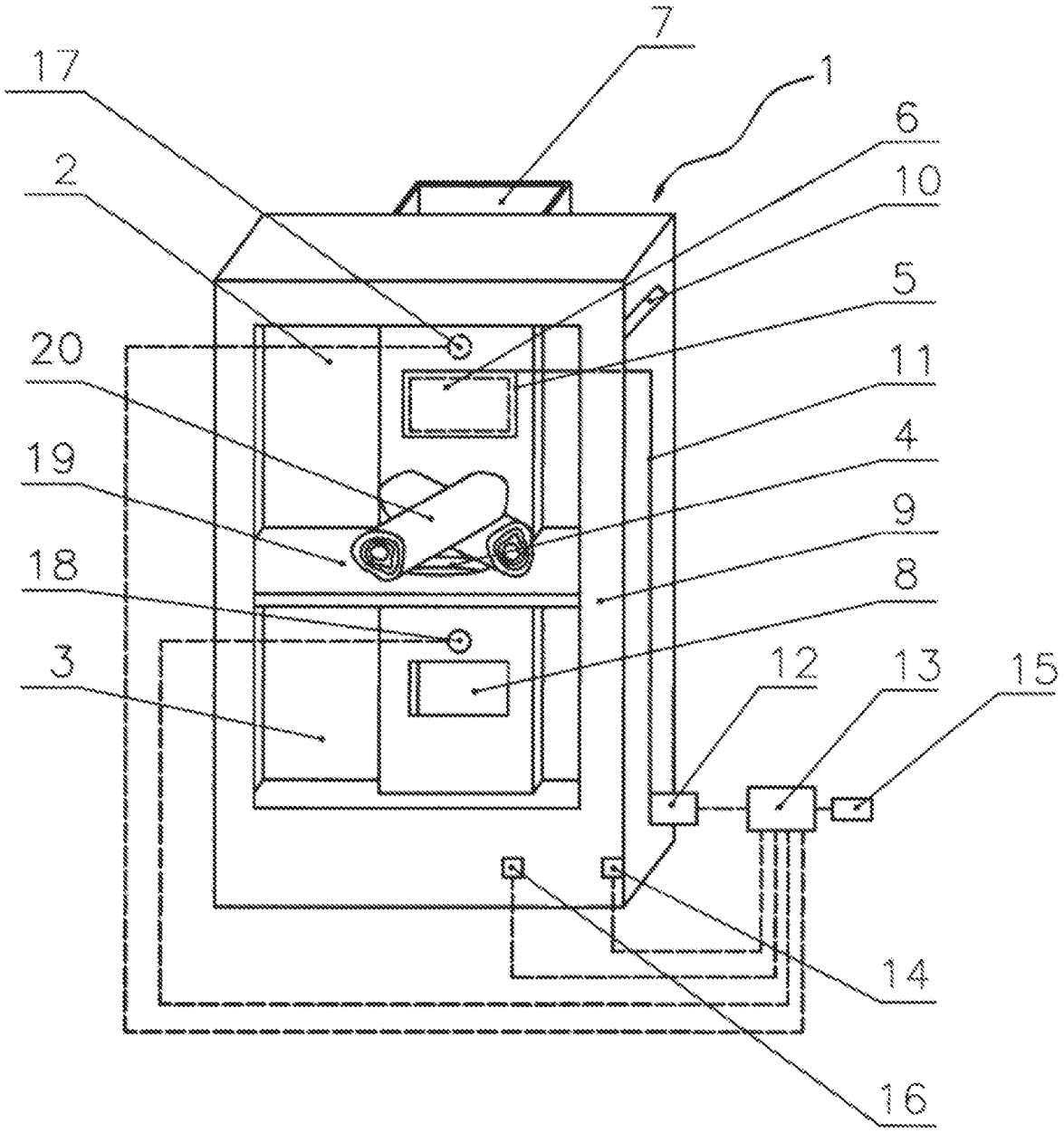

for the optimal combustion process is taken into account and the necessity of the new feed with solid fuel is determined via the program and displayed via a visual signaling device. The device is used for electronic control for a fireplace with lower burn.

The invention relates to a device that does not require operator intervention, operates without delay, does not require a mains connection, and meets the requirements of the regulations with respect to permissible pollutant emissions. The device consists of a control unit which is electrically connected to two temperature sensors and to a door contact switch and which actuates an actuator by means of an electric motor and transmission elements. The temperature is detected in the flue behind the outlet of the combustion chamber. The temperature sensors record the change in temperature over time and the speed of the change in temperature. The temperature target/actual evaluation is used to record the combustion state of the solid fuel. The degree of the outgassing process is determined by recording and evaluating the increase or decrease in temperature over time. The target/actual temperature over time compared to comparative values for optimising combustion is an adaptive system. Therefore, the composition of the solid fuel is taken into account for the optimum combustion process and the necessity of the new charging with solid fuel is determined by means of the programme and displayed by means of an optical signal transmitter. The device is used for electronic closed-loop control for a fireplace comprising a lower combustion system.

6 Claims, 7 Drawing Sheets

(58) Field of Classification Search
USPC ..... 126/502
See application file for complete search history.

(56) References Cited

U.S. PATENT DOCUMENTS

| | | | | | |
|---|---|---|---|---|---|
| 4,815,965 | A * | 3/1989 | Likins, Jr. | F23N 1/002 | 431/12 |
| RE34,298 | E * | 6/1993 | Gitman | F23G 5/008 | 110/211 |
| 5,606,924 | A * | 3/1997 | Martin | F23N 5/00 | 110/101 CD |
| 6,595,199 | B1 | 7/2003 | Anderson et al. | | |
| 2007/0266623 | A1 * | 11/2007 | Paoluccio | C10L 5/44 | 44/629 |

FOREIGN PATENT DOCUMENTS

| | | | |
|---|---|---|---|
| DE | 102009012905 | B3 | 1/2010 |
| EP | 2208938 | A2 | 7/2010 |

* cited by examiner

ELECTRONIC CLOSED-LOOP CONTROL DEVICE FOR FIREPLACES COMPRISING A LOWER COMBUSTION SYSTEM

CROSS REFERENCE TO RELATED APPLICATIONS

This application is a U.S. national phase filing under § 35 U.S.C. 371 which claims priority to pending International Application No. PCT/DE2021/000135 filed Aug. 25, 2020, and entitled "ELECTRONIC CLOSED-LOOP CONTROL DEVICE FOR FIREPLACES COMPRISING A LOWER COMBUSTION SYSTEM," which claims priority to and the benefit of German Patent Application No. 102020005202.9 filed Aug. 25, 2020, each of which are incorporated by reference herein in their entireties.

TECHNICAL FIELD

The invention relates to a device for electronic control for a low-emission log wood stove with two combustion chambers positioned one above the other in the optimized underfire principle according to the generic term of the first patent claim.

STATE OF THE ART

There are now various types of devices for regulating the air supply to optimize the combustion of solid fuels.

DE 20200311 U1 reveals a low-emission log wood-burning stove with an optimised underfire principle. This chimney has two superimposed combustion chambers which are separated by a combustion carrier/grate as a support for the solid fuel, whereby the lower combustion chamber serves as an afterburner chamber and ash box. To regulate the combustion, a handle is used, which operates a sealing device for the smoke exhaust in order to direct the combustion gases, produced during the combustion of the solid fuel in the first, upper combustion chamber, into the second, lower combustion chamber and to enable a low-emission and effective combustion.

The smoke is then extracted through an opening located in the lower combustion chamber.

This type of control has the disadvantage that all actuations of the closure device are carried out at the subjective discretion of the operator, on the basis of experience and feeling. The control by hand is very time-consuming, since depending on the state of the combustion again and again Corrections must be made. The actuation of the shutter cannot be carried out optimally, since the operator has no possibility to detect the temperature in the smoke extractor. A temperature detection is necessary to open or close the closure device at the optimal time or to determine the optimal time for refilling the solid fuel.

Furthermore, a control of a low-emission log wood fireplace with optimized underfire principle using a thermobimetal for actuating the closure device is known. Depending on the temperature surrounding the thermobimetal, the supply of fresh air is regulated. Here it is disadvantageous that if the thermobimetal closes the closure device and in the further course of the temperature drop is too large, for example by different conditions at the installation site and or the nature of the solid fuel (piece size, moisture content, etc.), the opening of the closure device can only take place after cooling of the thermobimetal. During the cooling period, a bad burn-up with increased pollutant emissions takes place. Optimal low-emission combustion cannot be achieved with this.

The skilled person is further aware of a regulation of the combustion air supply with the aid of a lambda probe. This principle is usually used for boilers for central heating and wood gasifiers. Here, the oxygen content in the combustion chamber or the residual oxygen content of the exhaust gas is permanently measured by the lambda probe and compared with the oxygen content of the air surrounding the boiler. The signal from the lambda probe can then be used to determine the necessary speed of a blower that regulates the supply of combustion air.

The disadvantage here is the need for a power connection, high acquisition costs and time-consuming installation.

It is becoming increasingly important to adapt the combustion process with solid fuel to ecological requirements and to continue to optimize it.

PRESENTATION OF THE INVENTION

The invention is based on the problem to create a simple solution in design and manufacture for a device for electronic control for a low-emission log wood stove with two combustion chambers positioned one above the other in the optimized underfire principle, which regulates reliably, precisely, without mains connection, independently, without intervention of the operator, is adapted to the individual characteristics of the stove by a freely parameterizable program of the control unit and thus meet the latest requirements of the Combustion Ordinance for the reduction of pollutant emissions and other provisions for obtaining the Blue Angel quality seal and eliminate the disadvantages of the state of the art.

According to the invention, the problem is solved in that the device for electronic control for a low-emission log wood stove from two superimposed combustion chambers, separated by a support for solid fuel with an output to the lower combustion chamber, a smoke extractor, an output in the upper combustion chamber for smoke exhaust with a closable flap, an exit in the lower combustion chamber to the smoke extractor, a combustion chamber door with a door lock/handle and a door contact switch exist and are characterized therein that a control unit (controller), electrically connected with at least two temperature sensors and a door contact switch, an electric motor which actuates at least one actuator (flap) via transmission elements, controls, wherein the temperature detection in the smoke exhaust behind the output of the respective combustion chamber takes place at least one temperature sensor each, the temperature sensors the Detecting temperature change over time and the speed of the temperature change, the temperature target-actual evaluation by the control unit (controller) over parameterizable time periods serves as an evaluation criterion for the combustion state of the solid fuel, the degree of the outgassing process (size and/or moisture content of the solid fuel) is detected by the recording and evaluation of the temperature rise and the temperature drop over time, the target actual Temperature over time in comparison with the comparative values stored in the program for combustion optimization as an adaptive system takes place so that the respective nature of the solid fuel (moisture, type of wood, piece size . . . ) is taken into account for the optimal combustion process and the necessity of the new feed with solid fuel is determined via the program and displayed via a visual signaling device that is clearly visible to the user.

Thus, a solution was found with which the above-mentioned disadvantages of the prior art are eliminated.

Advantageous embodiments of the invention emerge from the dependent claims.

Thus, it proves to be a favorable design of the device that the opening or closing process initiated by the control unit of the actuator flap, due to the use of an electric drive (electric motor), can be carried out almost instantaneously.

Another favorable embodiment of the device is when the electric drive (electric motor) is optionally connected via transmission elements or directly to the actuator flap.

Another possible embodiment is that the control can be carried out either in battery or mains operation.

The signaling of the operating states "regular operation", "recharging" or "disturbance" with its own coloring over a single optical signaling transmitter, leads to a further favorable design.

A supplementary embodiment is that a memory in the control unit that cannot be erased by the user records the operating hours, operating states, minimum and maximum temperatures for the purpose of traceability and, if necessary, can also serve to clarify warranty claims.

EXAMPLE OF EXECUTION

Exemplary embodiments of the device according to the invention is described in more detail below using an embodiment. It shows:

FIG. 1 a device according to the invention attached to the stove with optimized underfire principle as an exemplary arrangement with the actuator flap 5 closed, (before commissioning)

Figure 2:
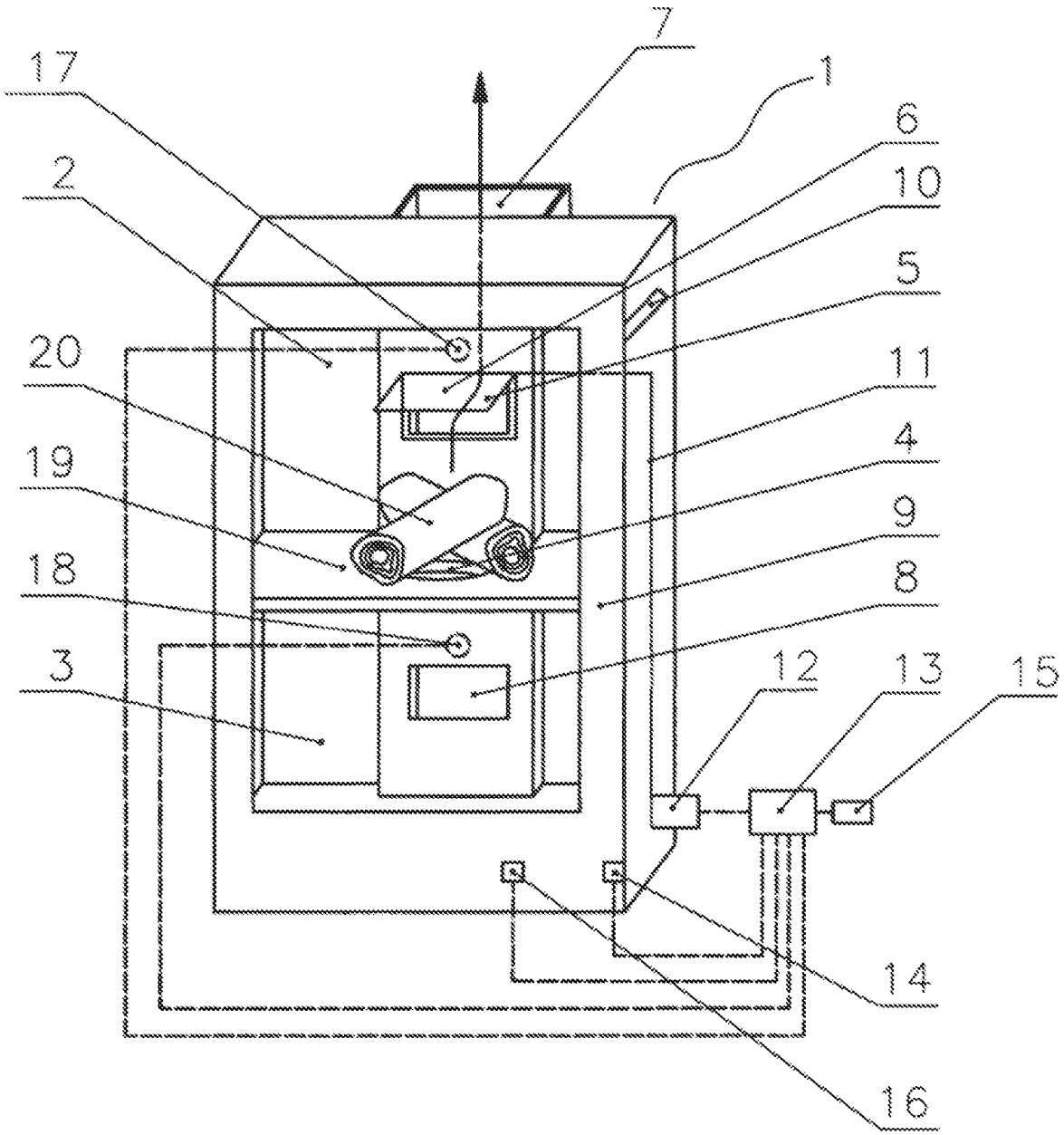
Figure 3:
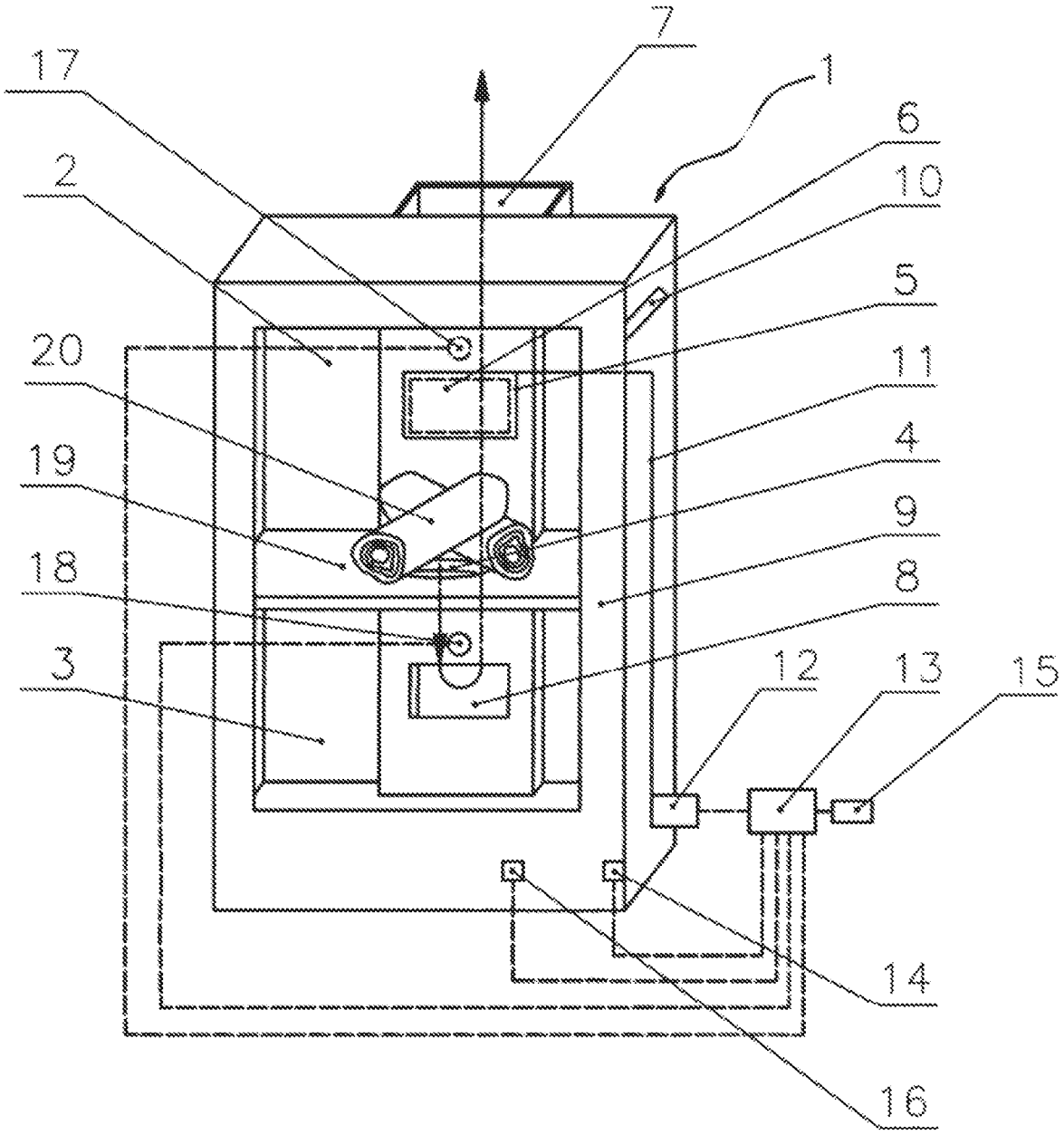

FIG. 2 a device according to the invention attached to the stove with optimized underfire principle as an exemplary arrangement with the actuator flap 5 opened (heating phase), FIG. 3 a device according to the invention attached to the stove with optimized underfire principle as an exemplary arrangement with the actuator flap 5 closed (control mode/burn-up).

Figure 4:
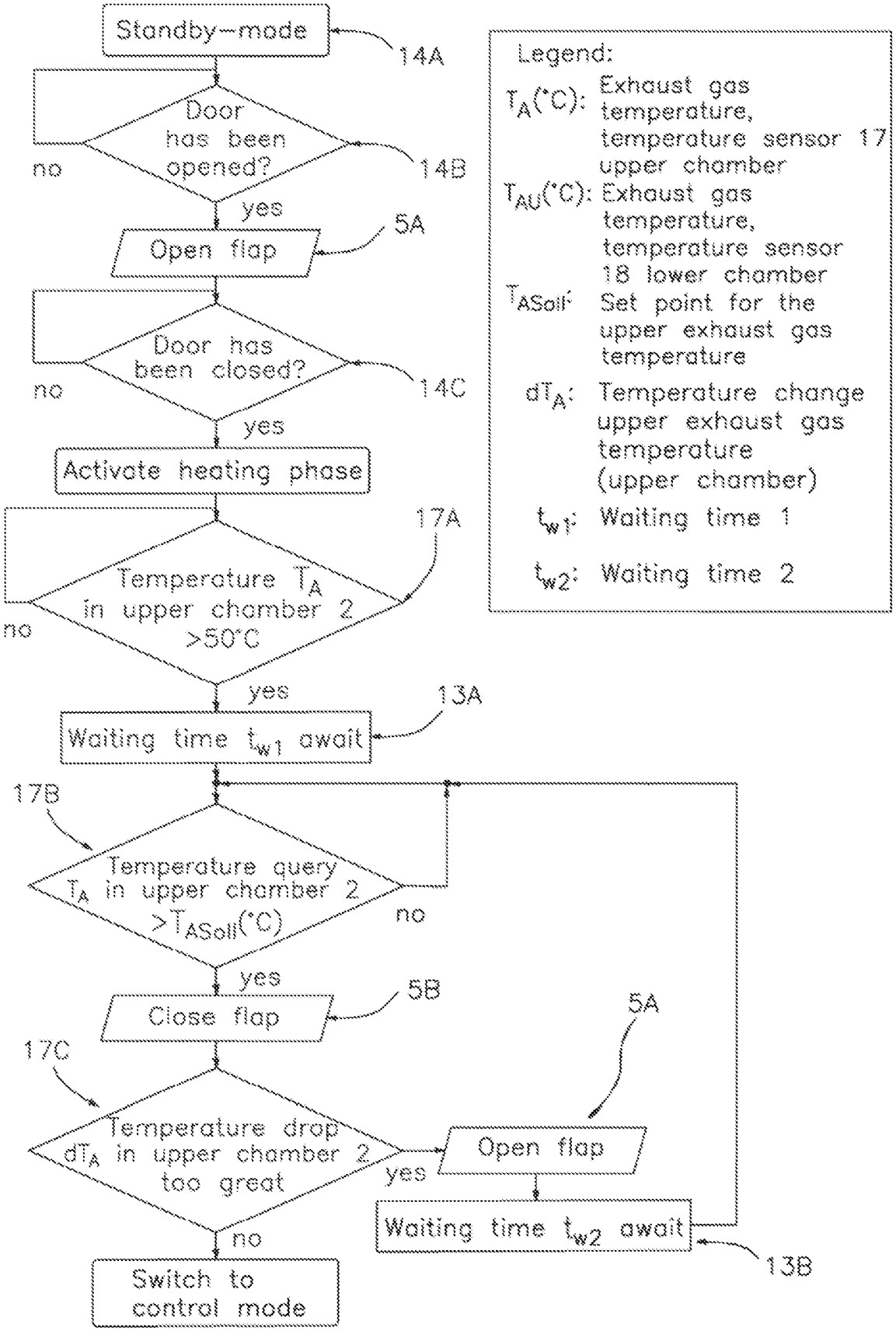
Figure 5:
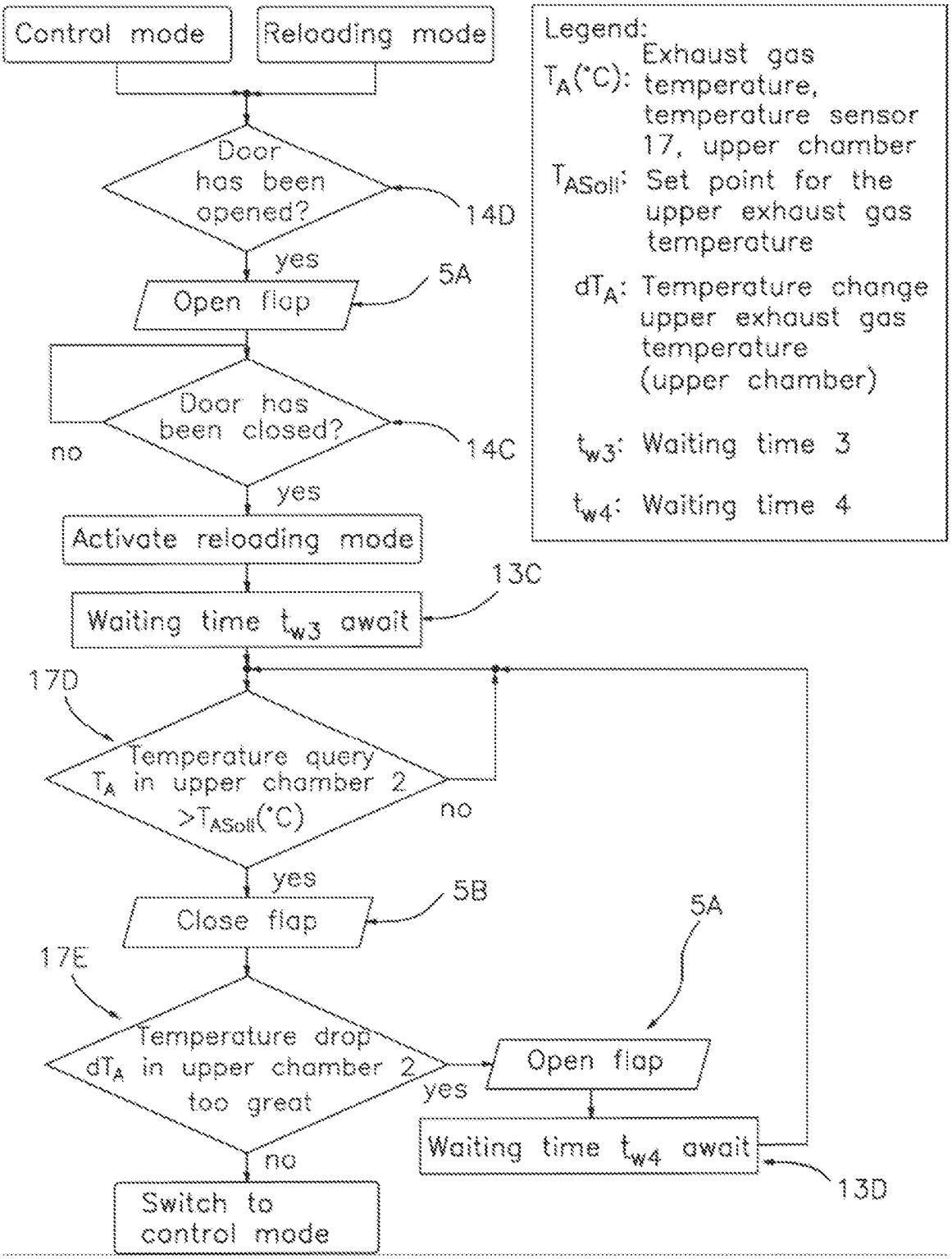
Figure 6:
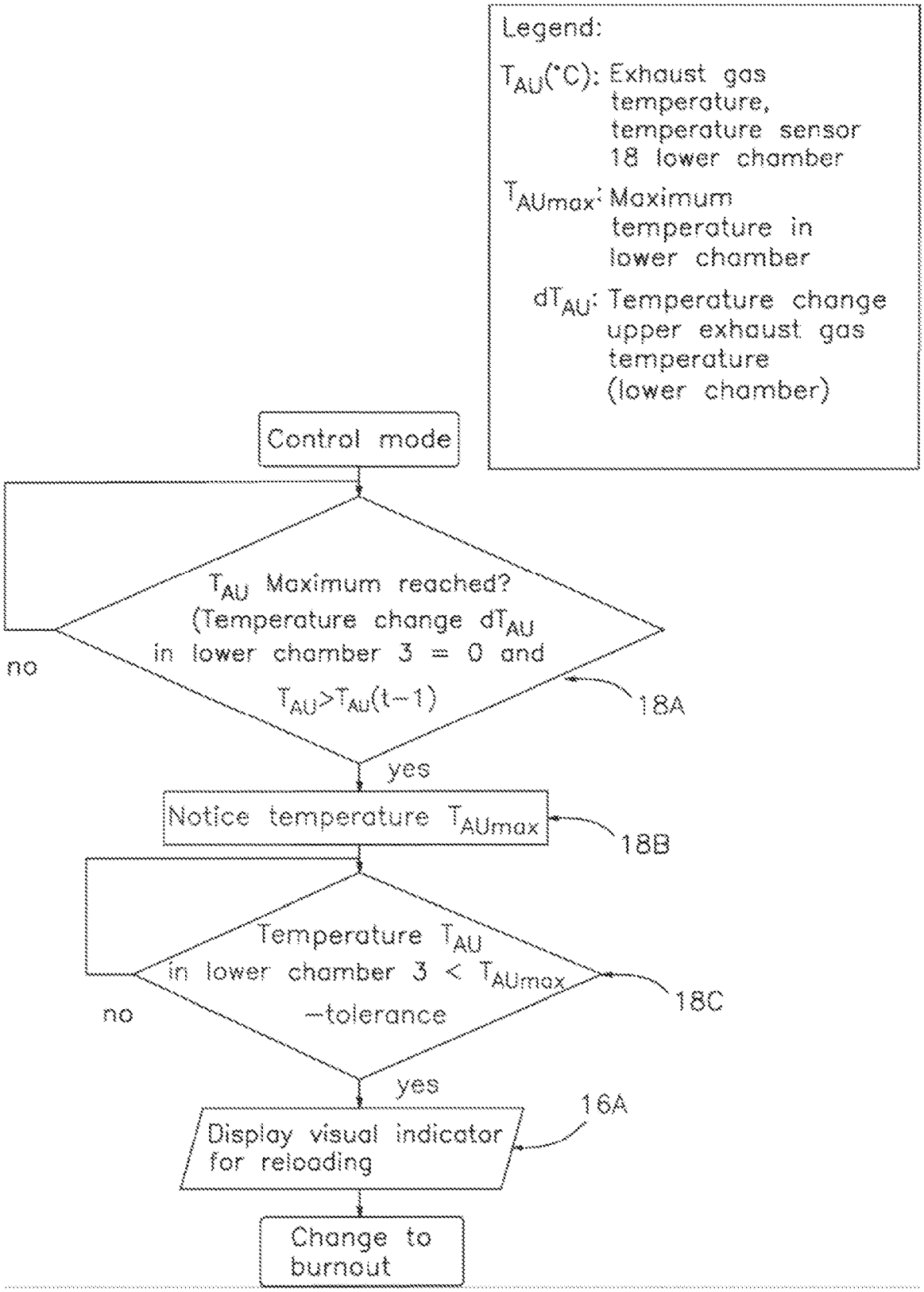
Figure 7:
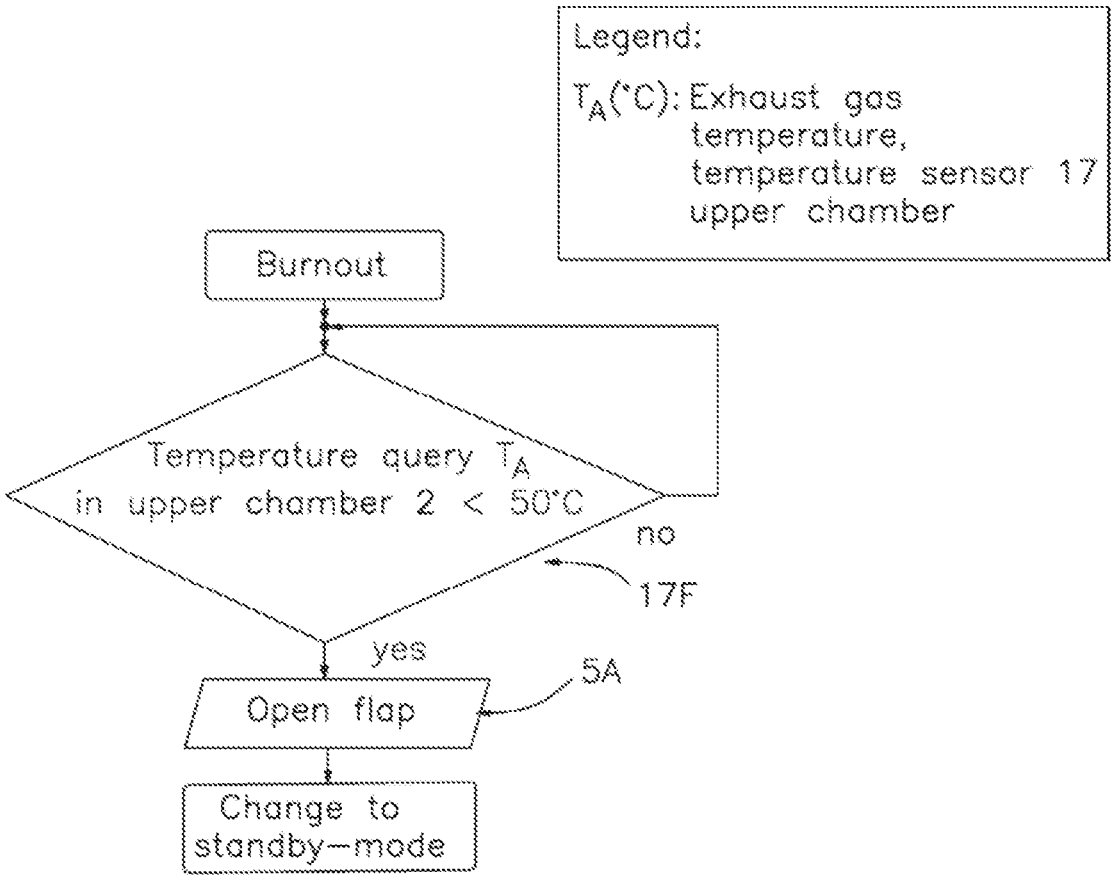

FIG. 4 a program flow chart of the control of the device according to the invention in the heating phase FIG. 5 a program flow chart of the control of the device according to the invention in control mode FIG. 6 a program flow chart of the control of the device according to the invention in the refill mode FIG. 7 a program flow chart of the control of the device according to the invention in the case of burnout FIG. 1 shows an exemplary structure including the device according to the invention, which is preferably intended for a low-emission log wood stove (1) with two combustion chambers positioned one above the other (2 and 3) in the optimized underfire principle. The device according to the invention enables the operation and monitoring of the combustion process of the solid fuel by controlling the combustion air supply. The operation by the user is limited only to the supply of solid fuel and ignition.

The stove 1 in this example consists of an upper combustion chamber 2 and a lower combustion chamber 3, separated by a shelf for the solid fuel 19. In this shelf is an outlet 4 to the lower combustion chamber 3. In the upper as well as in the lower combustion chamber 2 and 3 there are each an outlet 5 and 8 to the smoke outlet 7.

In the upper combustion chamber 2 is a valve 5 acting as an actuator which can close the output 6 to the smoke outlet 7 if necessary, as shown in FIG. 1. The opening and closing of the flap 5 is carried out via a transmission element 11, driven by an electric motor 12. The electric motor is electrically connected to the control unit 13. Both combustion chambers 2 and 3 are tightly closed with a firebox door 9 by means of door locking (handle) 10 to the surrounding installation space. In order to obtain information about the locking of the firebox door 9, a door contact switch 14 is attached. The door contact switch 14 is electrically connected to the control unit 13. The temperature sensors 17 and 18 necessary for controlling the combustion air are positioned behind the respective outputs 6 and 8 of the two combustion chambers 2 and 3 for flue gas extraction in flue gas outlet 7 and electrically connected to the control unit 13. At a well visible to the operator place of the chimney, expediently in the front area as shown in FIG. 1, there is an optical signaling device 16 as a display for prompting to refill the solid fuel, for indicating the operating state of normal operation or for signaling a fault, which is also connected to the control unit 13.

The mode of action of the low-emission log wood stove 1 with two superimposed combustion chambers 2 and 3 in the optimized underfire principle are known in the art. A more detailed presentation and explanation of the details is therefore omitted in this embodiment.

The description of the function of the device according to the invention follows the individual phases or modes of the combustion process. To illustrate the individual process steps, characterized by reference signs, the program flow chart shown in the drawings FIG. 4, FIG. 5, FIG. 6 and FIG. 7 is used.

Heating Phase (Prototype Diagram FIG. 4)

The necessary power supply of the control unit 13 is provided by a battery-operated voltage source 15. As a voltage source 15 can also alternatively serve a mains connection. When applying the voltage to the control unit 13, either by inserting batteries into the voltage source or via the mains connection, a reference run is made by the electric motor 12 for determining the position of the actuator flap 5 and checking the function. The controller 13 is now ready for operation in stand-by mode (procedure step 14A). With the first opening of the firebox door 9 of the chimney 1 in the cold state, the control unit is activated from stand-by mode via the door contact switch 14 (method step 14B) and via the electric motor 12 and the transmission element 11, the actuator flap 5 is switched to the open position via the electric motor 2 and the transmission element 5 (FIG. 20) (method step 19A). It is now stored the solid fuel 1 on the support 5 of the stove 9 and lit in a suitable manner. In order to achieve the optimal for the heating phase switching time, closing the actuator flap 10, and to make reproducible, the control begins after by closing the combustion chamber door 14 by means of door locking 13, a signal through the door contact switch 14, to the control unit < > was delivered (method step < > C) and a temperature rise above 50° C. has occurred. At the same time as the activation of the control unit 13, the temperature sensors 17 and 18 permanently measure the existing temperatures. After reaching the temperature of 50° C. "measured by the temperature sensor 17 behind the output 6 to the smoke outlet 7 (method step 17A), a waiting time twi (see) is activated by the control unit 13 (method step 13A) and the exhaust gas temperature TA (° C.) measured by the temperature sensor 17 in the smoke outlet 7. After expiry of the waiting period twi (see) and exceeding the flue gas temperature TA (° C.) specified in the program (method step 17B), the actuator flap 5 is closed by means of electric motor 12 and transmission element 11 (process step 5B) and the combustion gases are led through the output 4 into the lower combustion chamber 3, as in FIG. 3. After switching, it may happen that the temperature for the outgassing process TAU (° C.) is not yet sufficient or the stove is not yet optimally heated. As a result, the wood gas cannot be burned properly. By the temperature sensor 17, this situation of the strong temperature drop of the flue gas is detected and opened by a control command of the control unit 13 (method step 17C) the actuator flap 5 (method step 5A) by means of electric motor 12 and transmission element 11. The control unit 13 thereby activates again a waiting time tw2 (see) (method step 13B) and the exhaust gas temperature in the flue 7 is measured by the temperature sensor 17 until the preset temperature Tsoii (° C.) is reached again.

This process is repeated, controlled by the control unit 13, until a stable combustion has been established. The switch to the rule mode now takes place.

Rules Mode (Program Schedule FIG. 6)

After a stable combustion has been achieved, by detecting the maximum temperature TAU max by the temperature sensor 18 (process step 18A) in the lower combustion chamber 3, the fall below the value of a specified temperature corridor (TAU ma tolerance) after evaluation in the Control unit 13 (method step 18B) activated a reload signal (method step 18C) and signaled by a visual display 16, which shows the operator the correct time for reloading (method step 16A). Due to different amounts of each recharged solid fuel 20, the temperature corridor (TAU max tolerance) is determined in its expansion, but not the temperature level (TN) this is detected and determined by the control unit 13 after each refilling Night Mode (Program Chart FIG. 5)

For refilling, the firebox door 10 is opened by actuating the door lock 9 and the door contact switch 14 is actuated, a signal to the control unit 13 is given (method step 14D), which in turn controls the electric motor 12 and opens the actuator flap 11 via the transmission element 5 (method step 5A). After closing the door (method step 14C), a parameterized waiting time tw3 (see) is activated (method step 13C) and the exhaust gas temperature is measured by the temperature sensor 17 in the smoke outlet 7 (method step 17D). After the expiry of the waiting period tw 3 (see) and exceeding the flue gas temperature TA (° C.) specified in the program, the actuator flap 5 is closed via the already known actuators 11 and 12 (method step 5B) and the combustion gases are led through the outlet 4 into the lower combustion chamber 3. After switching, it may happen that the temperature TAU (° C.), e.g. due to too large pieces of wood or too wet wood, etc., is not yet sufficient for the outgassing process. In this case, a strong temperature drop of the flue gas is measured by the temperature sensor 17 and detected by the control unit 13 (method step 17E) and actuator flap 5 (method step 5A) opened. As a result, a parameterized waiting time t«4 (see) is activated again (method step 13D) and the exhaust gas temperature in the smoke outlet 7 is measured by the temperature sensor 17 until a preset temperature Tsoii (° C.) is reached again. This process is repeated, controlled by the control unit 13, until a stable combustion has been established.

Burn-Out (Program Flowchart FIG. 7)

If the exhaust gas temperature TA (° C.), measured by the temperature sensor 17 falls below a specified value TA son (method step 17F) and is no longer refilled, the actuator flap 5 is opened (method step 5A). The remaining solid fuel 20 burns down and the chimney cools. If the temperature measured by temperature sensor 17 in smoke outlet 7 drops below 50° C., the control unit 13 deactivates and goes into stand-by mode.

The device according to the invention is of course not limited to the embodiment shown. Rather, changes and modifications are possible without leaving the scope of the invention.

LIST OF REFERENCE SIGNS

1 woodburning stove
2 upper combustion chamber
3 lower combustion chamber
4 output (to the lower combustion chamber)
5 actuator flap
6 upper outlet (for smoke extraction)
7 Smoke vent
8 lower outlet (for smoke extraction)
9 Firebox door
0 Door locking (handling)
1 transmission element (to the actuator flap (5)) 2 Electric motor
3 Control unit (controller)
4 door contact switches
5 Voltage source
6 optical signaling devices
7 temperature sensors (upper combustion chamber)
8 temperature sensors (lower combustion chamber)
9 Edition for solid fuel
0 Solid fuel

LIST OF REFERENCE SIGNS FOR THE PROCESS STEPS

Open a flap 5
B Close flap 5
A Waiting time
B Waiting time tw2
C Waiting time tw3
D Waiting time tw4
A Firebox door 4 has been opened from standby mode B Firebox door 4 has been opened
C Firebox door 4 was closed
D Firebox door 4 was opened from control or refill mode
A optical signaling device 16 display for refilling
A Temperature sensor 17 Upper combustion chamber 2 with TA>50° C. B Temperature sensor 17
Upper combustion chamber 2 with TA>TASOII in heating phase
C Temperature drop dTA in upper combustion chamber 2 in heating phase too large
D Temperature sensor 17 with TA>TASOII in replenishment mode E Temperature drop dTA in upper combustion chamber 2 in
Refill mode too large
F Temperature sensor 17 with TA<50° C. in burn-out mode A Temperature sensor 18
Determination of maximum temperature TAU in the lower combustion chamber 3
B Storage of maximum temperature TAU in the lower combustion chamber 3
C Temperature sensor 18 Wait until temperature TAU falls below the tolerance limit

The invention claimed is:

1. A device for electronic control of stoves with lower combustion consisting of two combustion chambers positioned one above the other, separated by a support for solid fuel with an outlet to the lower combustion chamber, a flue, an outlet in an upper combustion chamber to the flue with a flap that can be closed, an outlet in the lower combustion chamber to the flue, a combustion chamber door with a door lock/handle and a door contact switch wherein:

a control unit electrically connected with at least two temperature sensors, the door contact switch, and an electric motor, which actuates via transmission elements the actuation of at least one actuator flap, the control unit controlling;

temperature detection in the flue behind output of the respective combustion chamber by at least one of the at least two temperature sensors, the temperature sensors detect the temperature change over time, the temperature sensors detect a speed of temperature change, temperature evaluation by the control unit over parameterizable periods of time serves as an evaluation criterion for a combustion state of the solid fuel, degree of outgassing is detected by recording and evaluating the temperature rise or temperature drop over time, the temperature over time is compared with comparative values stored in a program for combustion optimization as an adaptive system, thus a respective nature of the solid fuel is taken into account for an optimal combustion process, a need for a new solid fuel feed is determined by the program and displayed via a visual signaling device that is clearly visible to a user.

2. A device for electronic control according to claim 1 wherein an opening or closing process initiated by the control unit of the actuator flap, due to the use of an electric motor, is instantaneous.

3. A device for electronic control according to claim 1 wherein, the electric motor is connected via the transmission elements to the actuator flap.

4. A device for electronic control according to claim 1 wherein, the control can be carried out either in battery or mains operation.

5. A device for electronic control according to claim 1 wherein, a signaling of operating states "normal operation", "reloading" or "disturbance" with its own coloring via a single optical signaling device takes place.

6. A device for electronic control according to claim 1 wherein, operating hours, operating states, minimum and maximum temperatures are recorded for traceability via a memory in the control unit that cannot be erased by the user.

* * * * *